US006099235A

United States Patent [19]

Cain et al.

[11] Patent Number: 6,099,235

[45] Date of Patent: Aug. 8, 2000

[54] ARRANGEMENT FOR DETERMINING THE RELATIVE ANGULAR ORIENTATION BETWEEN A FIRST MACHINE ELEMENT AND A SECOND MACHINE ELEMENT

[75] Inventors: Gary Lynn Cain, Springfield; Richard Piekutowski, Huber Heights, both of Ohio

[73] Assignee: Spectra Precision, Inc., Dayton, Ohio

[21] Appl. No.: 08/984,861

[22] Filed: Dec. 4, 1997

[51] Int. Cl.[7] ..... E02F 3/43

[52] U.S. Cl. ..... 414/694; 33/710; 92/5 R

[58] Field of Search ..... 414/694, 697, 414/698; 33/710, 809, 810, 1 PT; 92/5 R; 242/615.3; 414/699

[56] References Cited

U.S. PATENT DOCUMENTS

| | | | |
|---|---|---|---|
| 3,017,046 | 1/1962 | Runci et al. . | |
| 3,141,563 | 7/1964 | Fisher . | |
| 4,020,963 | 5/1977 | Carter . | |
| 4,182,599 | 1/1980 | Eyrick et al. | 92/5 R X |
| 4,793,241 | 12/1988 | Mano et al. . | |
| 4,879,440 | 11/1989 | Lymburner | 92/5 R X |
| 4,898,079 | 2/1990 | Combette . | |
| 4,964,779 | 10/1990 | Sagaser . | |
| 4,987,822 | 1/1991 | Stoll . | |
| 5,062,264 | 11/1991 | Frenette et al. . | |
| 5,231,352 | 7/1993 | Huber . | |
| 5,461,803 | 10/1995 | Rocke . | |

FOREIGN PATENT DOCUMENTS

| | | | |
|---|---|---|---|
| 2665199 | 1/1992 | France | 414/699 |

OTHER PUBLICATIONS

OakGrigsby Brochure, 900 Series Optical Encoders, 1996.
UniMeasure brochure, Position and Velocity Transducers.
UniMeasure brochure, HX–EP Series Position Transducer.
SpageAge Control, Inc. "Application Note".
Cable Manufacturing & Assembly Co., Inc. product information.

*Primary Examiner*—Donald W. Underwood
*Attorney, Agent, or Firm*—Killworth, Gottman, Hagan & Schaeff, LLP

[57] ABSTRACT

An arrangement is provided for determining the relative angular orientation between an excavator bucket and the dipper stick of an excavator. The excavator bucket is mounted on a bucket linkage that is pivotally secured to the end of the dipper stick. An hydraulic actuator has an hydraulic cylinder pivotally connected to the dipper stick, and a piston pivotally connected to the bucket linkage. Extension or contraction of the hydraulic actuator causes the excavator bucket to be pivoted by the bucket linkage with respect to the dipper stick. A cable extension linear position transducer having a transducer casing, a sheath extending from the casing, and an extensible cable extending from the sheath, provides an electrical output related to the extension of the cable from the sheath. A transducer mounting secures the casing of the cable extension linear position transducer in fixed relationship to the hydraulic cylinder. A clip secures the extensible cable to the piston. By this arrangement, extension or contraction of the hydraulic actuator causes the output of the transducer to vary, thus providing an electrical output related to the relative angular orientation of the excavator bucket with respect to the dipper stick.

23 Claims, 9 Drawing Sheets

ARRANGEMENT FOR DETERMINING THE RELATIVE ANGULAR ORIENTATION BETWEEN A FIRST MACHINE ELEMENT AND A SECOND MACHINE ELEMENT

BACKGROUND OF THE INVENTION

The present invention relates to an arrangement for determining the relative angular orientation between a first machine element and a second machine element and, more particularly, to an arrangement for determining the relative angular orientation of an excavator bucket with respect to the dipper stick of the excavator.

Control systems have been developed for monitoring and automatically controlling the operation of various types of construction equipment, such as for example excavators. Such systems of this general type are disclosed in U.S. Pat. No. 5,461,803, issued Oct. 31, 1995, to Rocke; U.S. Pat. No. 5,062,264, issued Nov. 5, 1991, to Frenette et al; and U.S. Pat. No. 4,964,779, issued Oct. 23, 1990, to Sagaser. In each of these patents, a positioning and control system is disclosed that includes an arrangement for measuring the relative positions of various machine elements, comparing the measured positions with the desired positions in a feedback control system, and adjusting the machine element positions accordingly. In the Rocke patent, displacement sensors sense the amount of piston extension in the boom, dipper stick, and bucket hydraulic actuators. To accomplish this, a radio frequency sensor is provided inside each of the hydraulic cylinders. The sensor includes a pair of loop antennas that transmit and receive radio frequency electromagnetic signals, exciting a transverse electromagnetic field in the cavity when the frequency of the signal corresponds to the resonant frequency of the cavity. The resonant frequency of the cavity is primarily dependent upon the longitudinal length of the cavity. Therefore, a voltage controlled oscillator acts under the control of a sawtooth voltage waveform from a function generator to deliver a variable frequency signal to the first loop antenna. An RF detector monitors the second loop antenna for an indication that the resonant frequency has been reached. At resonance, a microprocessor samples the output of the voltage-controlled oscillator and correlates the resonant frequency to the length of the coaxial cavity.

The Frenette patent suggests that angle encoders at the pivot points between machine elements may be used to measure the relative positions of these machine elements. Alternatively, the Frenette patent suggests that a sensor measuring the displacement of an actuator, or a camera recording the location of the machine elements may be used. Finally, the Sagaser patent discloses the use of a special hydraulic actuator that includes a specially constructed potentiometer arrangement inside the actuator that varies in electrical resistance in relation to the extension of the piston.

These arrangements are expensive, require special parts, and may require frequent service adjustments. Further, the length of time required for servicing such arrangements may be longer than is desirable, due to the need to disassemble the actuators or other components. Accordingly, it is seen that there is a need for a simple, rugged, reliable, and economical arrangement for determining the relative angular orientation between a first machine element and a second machine element.

SUMMARY OF THE INVENTION

These needs are met by an arrangement according to the present invention for determining the relative angular orientation between a first machine element and a second machine element. For example, the present invention may be used to determine the angular orientation of an excavator bucket with respect to the dipper stick of an excavator. The excavator bucket is mounted on a bucket linkage that is pivotally secured to the end of the dipper stick. The machine further includes a linear actuator having a first actuator element pivotally connected to the first machine element and a second actuator element pivotally connected to the second machine element. The first and second actuator elements are linearly moveable with respect to each other, whereby relative linear movement of the actuator elements causes relative pivotal movement between the first and second machine elements. The linear actuator preferably comprises an hydraulic actuator, with the first actuator element comprising an hydraulic cylinder pivotally connected to the dipper stick, and the second actuator element comprising a piston pivotally connected to the bucket linkage. Extension or contraction of the hydraulic actuator causes the excavator bucket to be pivoted by the bucket linkage with respect to the dipper stick. This arrangement includes a cable extension linear position transducer having a transducer casing, a sheath extending from the casing, and an extensible cable extending from the sheath. The transducer provides an electrical output related to the extension of the cable from the sheath. A transducer mounting secures the casing of the cable extension linear position transducer in fixed relationship to the hydraulic cylinder. A clip secures the extensible cable to the piston. By this arrangement, extension or contraction of the hydraulic actuator causes the output of the transducer to vary, thus providing an electrical output indicating the relative angular orientation of the excavator bucket with respect to the dipper stick.

The clip includes a band around the piston, strapping the cable to the piston adjacent to the bucket linkage. A mounting is provided for securing the sheath to the hydraulic cylinder near the end of the cylinder from which the piston emerges. The sheath includes a rigid end portion from which the cable extends. The rigid end portion includes an outer rigid tube, an inner rigid tube within the outer rigid tube, and a flexible liner within the inner rigid tube. The rigid end portion is oriented such that the cable emerges from the rigid end portion in close proximity to the piston and extends in close proximity to the piston. The cable extension linear position transducer is mounted such that the sheath and extensible cable extend along the cylinder and the piston on the sides thereof generally facing the dipper stick. By this arrangement, the sheath and extensible cable are partially protected by the cylinder and piston. The cable extension linear position transducer may be mounted such that the sheath and extensible cable both extend along the cylinder and the piston on the side thereof generally, but not directly facing the dipper stick. Alternatively, the sheath and extensible cable may extend along the cylinder and the piston on the side thereof directly facing the dipper stick. By these arrangements, the sheath and extensible cable are protected by the cylinder and piston. The extensible cable includes a first cable portion extending from the transducer casing, and a second cable portion extending from the sheath. The first and second cable portions are attached together within the sheath.

Accordingly, it is an object of the present invention to provide an improved arrangement for monitoring the relative angular orientation between a pair of pivotally linked machine parts; to provide a sturdy, simplified mechanism for such monitoring; and to provide an accurate arrangement for accomplishing such monitoring. Other objects and advantages of the invention will be apparent from the following detailed description, the accompanying drawings, and the appended claims.

DETAILED DESCRIPTION OF THE PREFERRED EMBODIMENT

Figure 1:
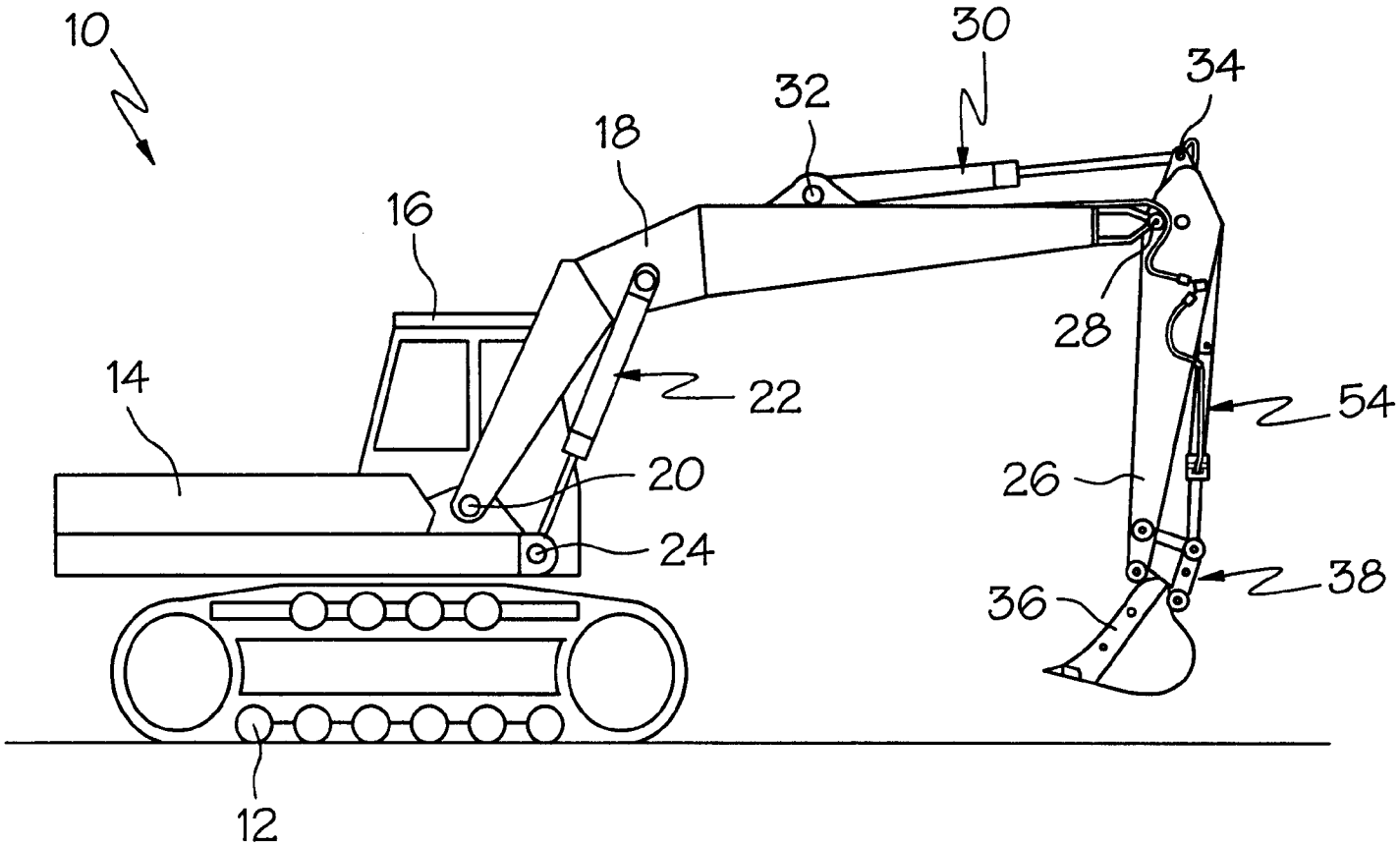
FIG. 1 is a drawing diagrammatically representing a typical excavator of the type with which the present invention may be used.
Figure 2:
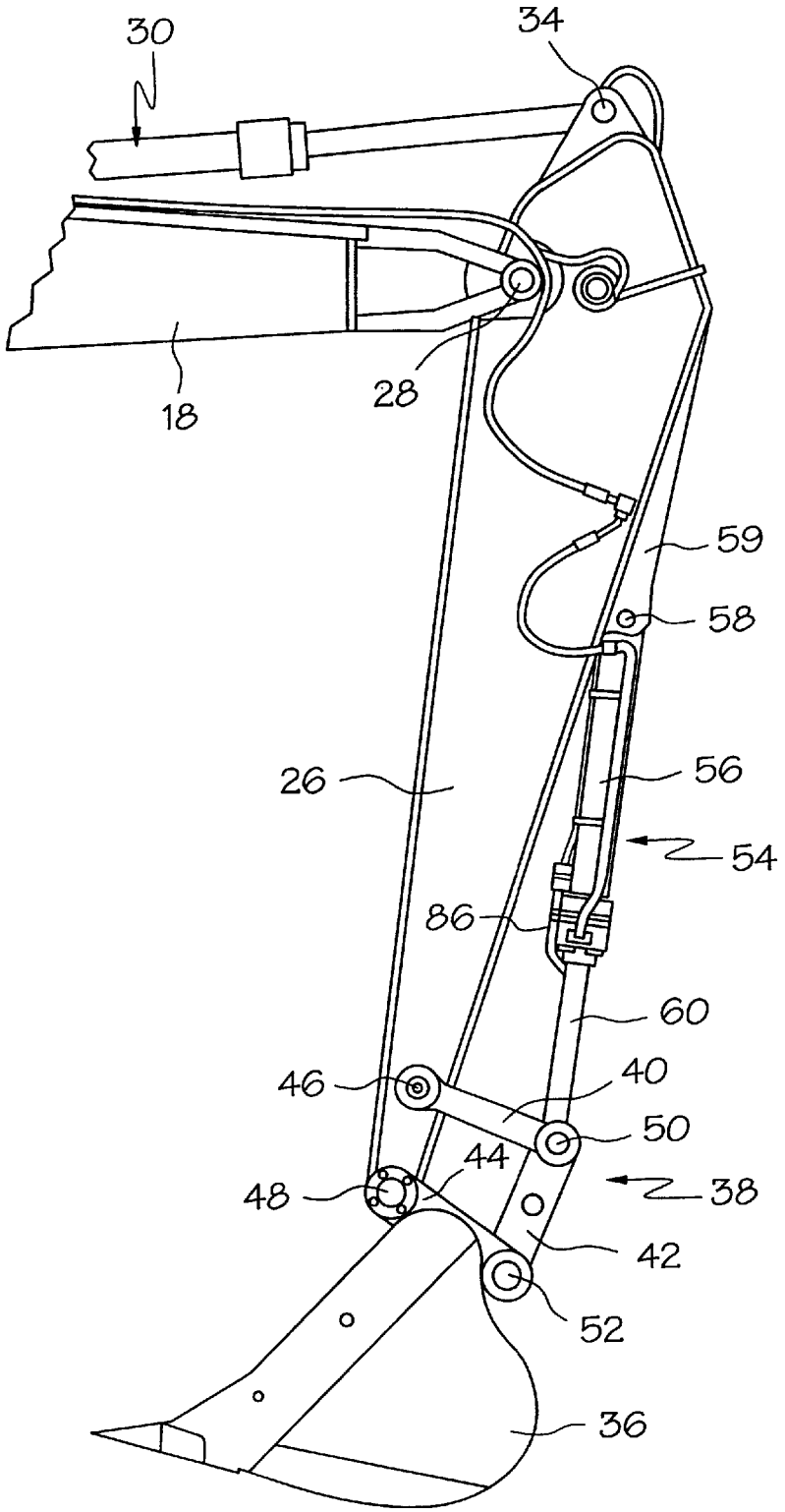
FIG. 2 is an enlarged view of the dipper stick, bucket and bucket linkage of the excavator, with a portion of the boom broken away.
Figure 3:
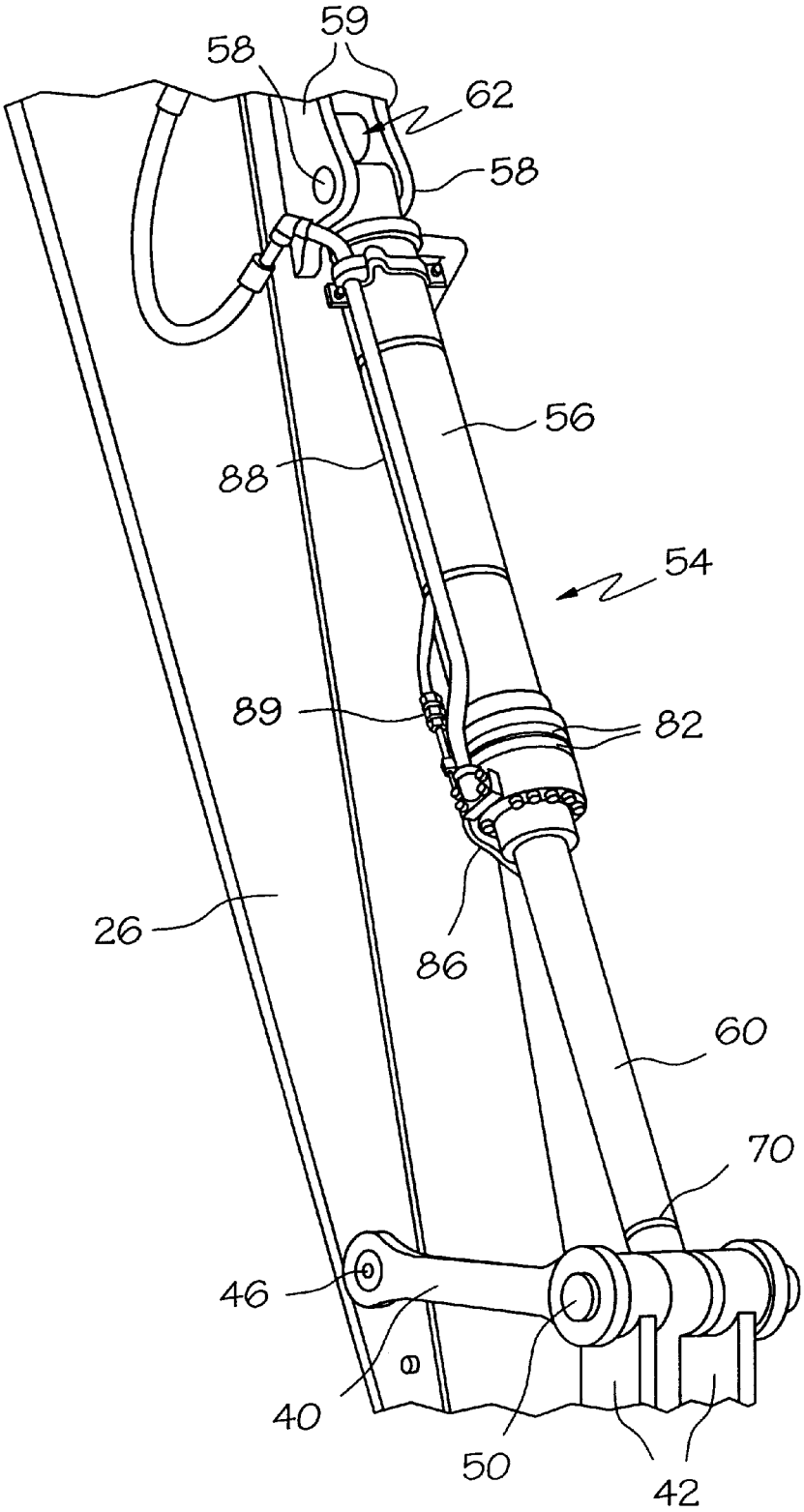
FIG. 3 is a further enlargement of the central portion of the dipper stick, with the upper and lower portions of the dipper stick broken away.

Reference is now made to FIGS. 1–3, which illustrate a typical excavator 10 of the type with which the present invention may be used. Excavator 10 includes ground engaging tracks 12, and a body 14 which has an operator cab 16. A boom 18 is pivotally attached to body 14 at 20. Boom 18 is also pivotally attached to hydraulic actuator 22, which is secured to body 14 at 24 in such a manner that extending actuator 22 causes boom 18 to be raised, and retracting actuator 22 causes boom 18 to be lowered. In similar fashion, dipper stick 26 is pivotally attached to the end of boom 18 at 28. Hydraulic actuator 30 is pivotally attached to boom 18 at 32, and to dipper stick 26 at 34, such that extending actuator 30 causes dipper stick to be rotated in a clockwise direction as seen in FIG. 1, and retracting actuator 30 causes dipper stick to be rotated in a counterclockwise direction as seen in FIG. 1.

In turn, excavator bucket 36 is mounted on a bucket linkage 38 that is pivotally secured to the end of the dipper stick. Bucket linkage 38 includes a pair of parallel links 40 (only one of which is visible in FIGS. 1–3), a pair of parallel links 42 (both of which are visible in FIG. 3) and a pair of parallel links 44 (only one of which is visible in FIGS. 1–3) to which bucket 36 is attached. Links 40 and 44 are pivotally attached to dipper stick 26 at 46 and 48, respectively, and to links 42 at 50 and 52, respectively.

The excavator 10 further includes an hydraulic actuator 54 having an hydraulic cylinder 56 pivotally connected to the dipper stick 26 at 58 between a pair of ridges 59. The hydraulic actuator 54 has a piston rod 60 that is pivotally connected to the bucket linkage 38 at 50. Extension or contraction of the hydraulic actuator 54 causes the excavator bucket 36 to be pivoted by the bucket linkage 38 with respect to the dipper stick 26.

The present invention provides an arrangement for determining the relative angular orientation between a first machine element, the dipper stick 26, and a second machine element, the excavator bucket 36, including the bucket linkage 38, where movement is effect by means of an extensible hydraulic actuator 54 which includes cylinder 56 and piston rod 60. It will be appreciated, however, that this invention has application to constructions in which any sort of linear actuator has linearly moveable elements which cause pivotal movement between machine elements.

In order to monitor the relative position of the bucket 36 and the dipper stick 26, the extension of hydraulic actuator 54 is determined. Once the extension of the actuator 54 is measured, it is a straightforward calculation, based on the geometry of the dipper stick 26, bucket 36, actuator 54, and linkage 38, to determine the relative positions of the bucket 36 and dipper stick 26.

Figure 4:
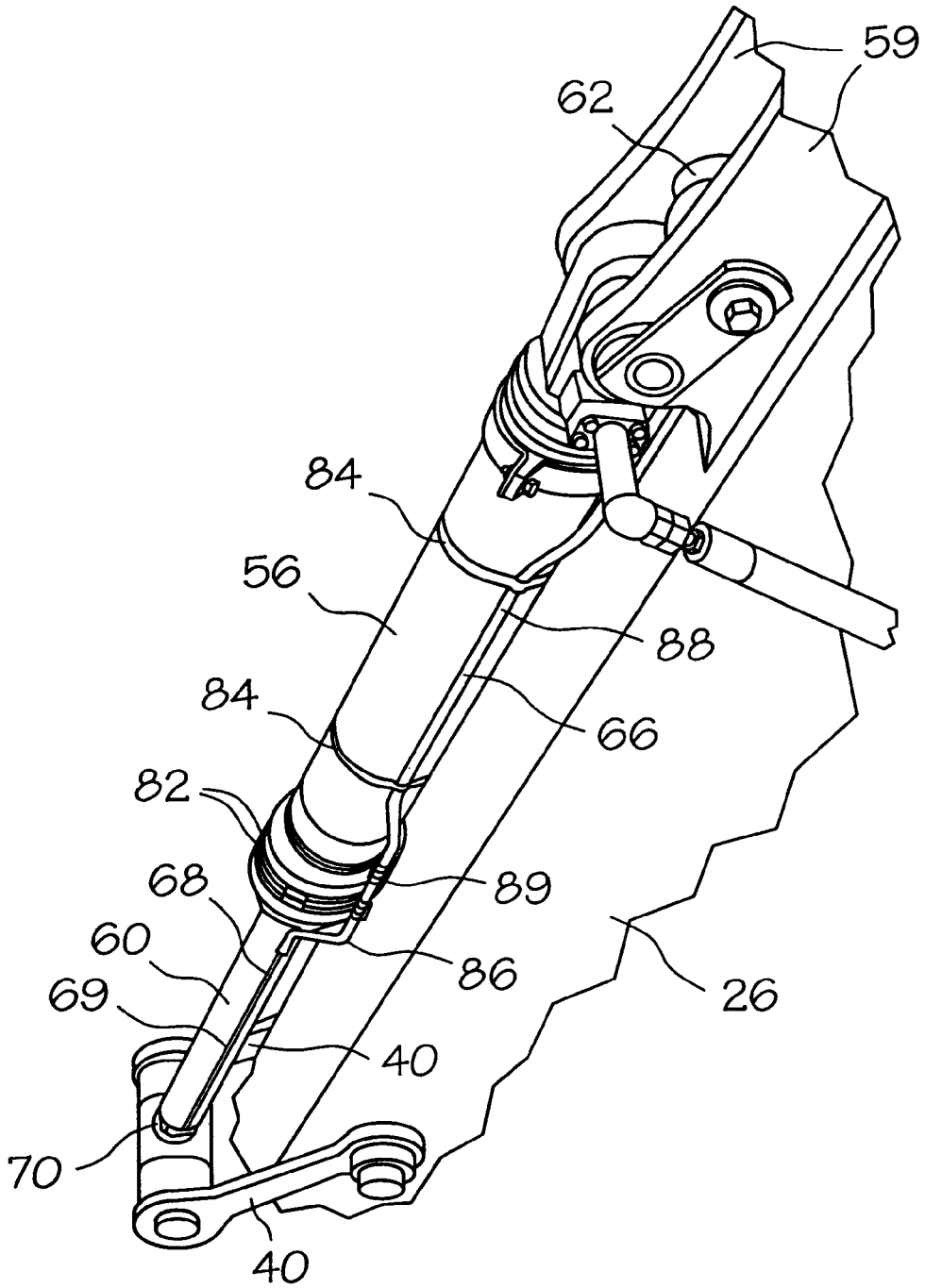
FIG. 4 is a further enlargement of the central portion of the dipper stick, with the upper and lower portions of the dipper stick broken away, as seen from the side of the dipper stick opposite that shown in FIG. 3, illustrating the mounting arrangement for the transducer sheath and a clip that secures the extensible cable to the piston.
Figure 5:
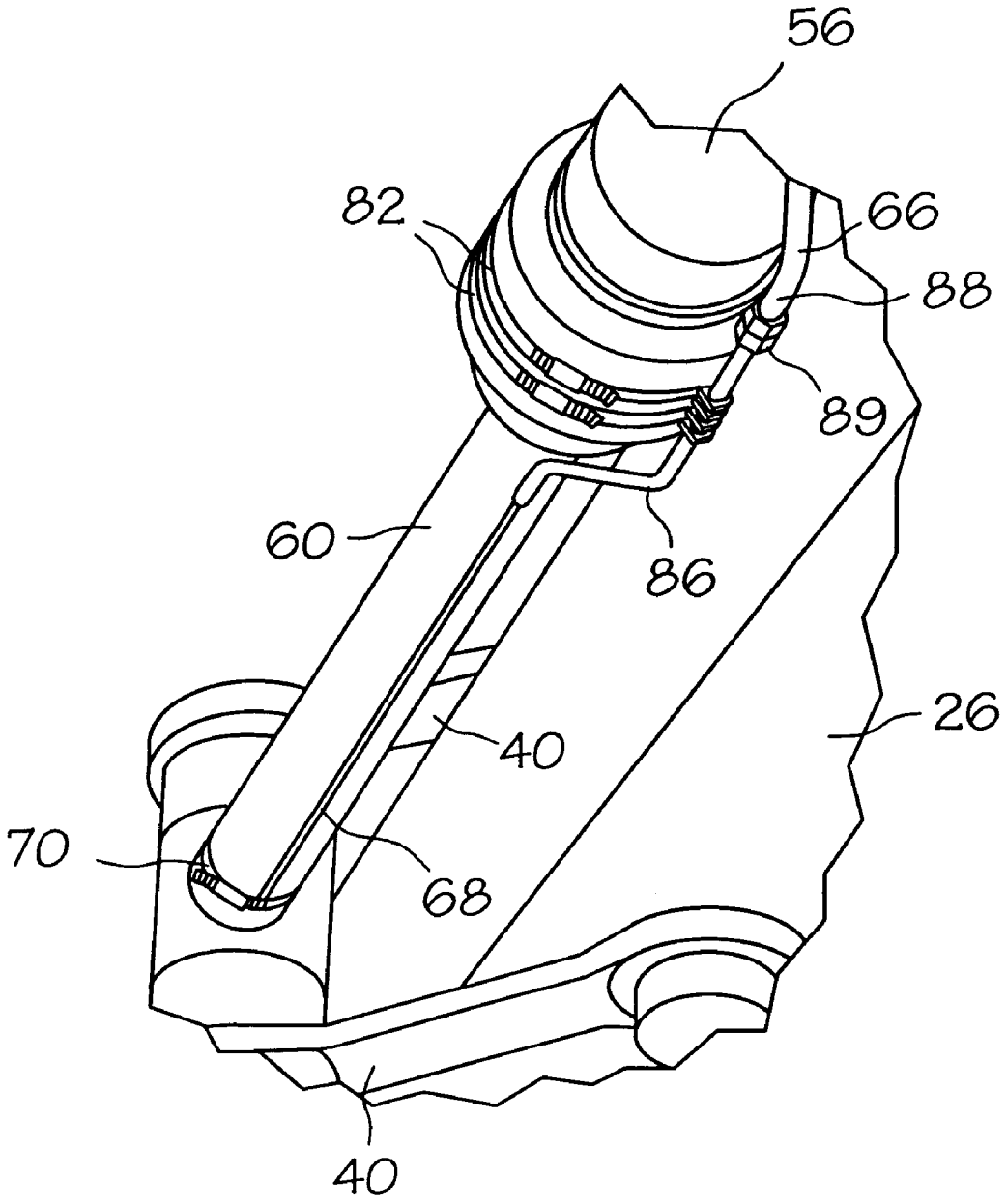
FIG. 5 is a further enlargement of the lower portion of the dipper stick, with the upper and lower portions of the dipper stick broken away, as seen from the same side of the dipper stick shown in FIG. 4, and illustrating the transducer mounting arrangement and the clip in greater detail.
Figure 6:
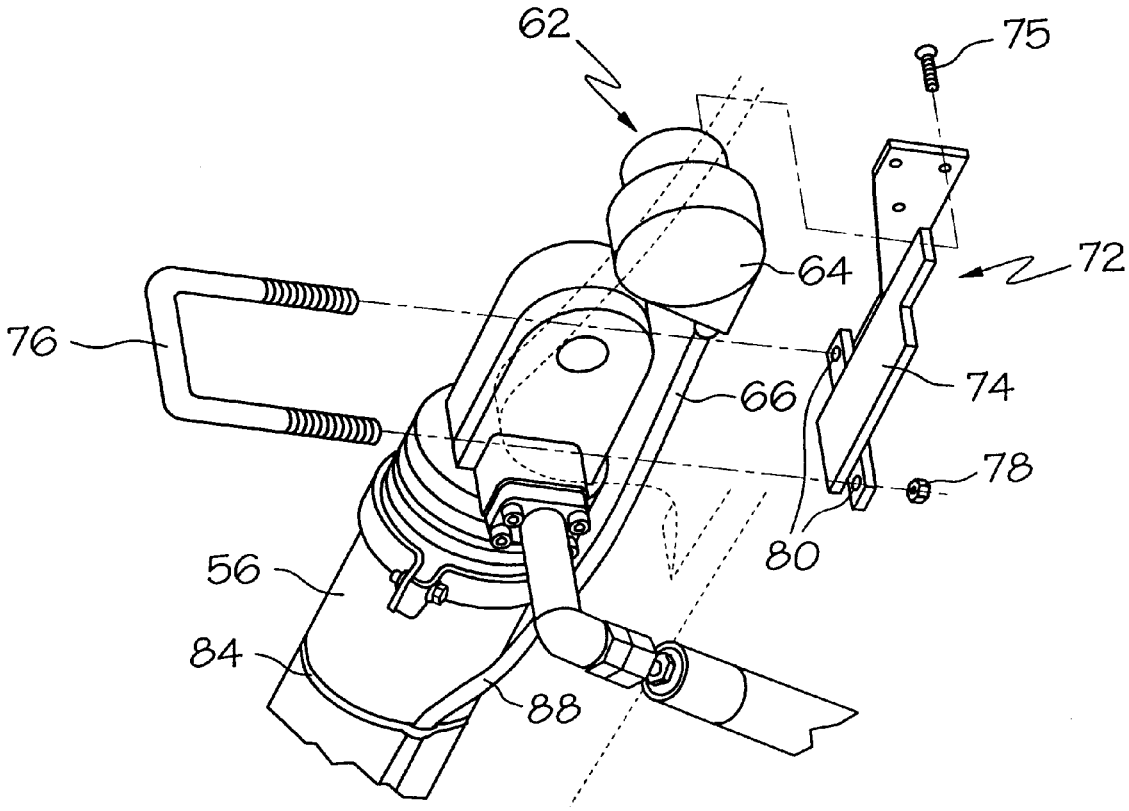
FIG. 6 is an exploded enlargement of the upper end of the hydraulic actuator associated with the dipper stick and bucket linkage, illustrating the cable extension linear position transducer and the transducer mounting that secures the casing of the transducer to the hydraulic cylinder.

As best seen in FIGS. 4–6, but with continuing reference to FIGS. 1–3, the arrangement of the present invention includes a cable extension linear position transducer 62 having a transducer casing 64, a sheath 66 extending from the casing 64, and an extensible cable 68 that extends from the sheath 66. Transducer 62 may be generally of the type available from UniMeasure, Inc., 501 SW Second Street, Corvallis, Oreg. 97333, or from Space Age Control, Inc., 38850 20th Street East, Palmdale, Calif. 93550, although a transducer construction is illustrated and described below with respect to FIGS. 7–9. Such a cable extension linear position transducer does not require critical alignment, is compact in size, rugged, dependable, and is easily installed and serviced. This type of transducer, also known as a string pot, a yo-yo pot, a cable displacement transducer, and a draw wire transducer, provides an electrical output in dependance upon the extent to which the extensible cable is unreeled from the transducer. The cable is attached to a moving object and, as movement occurs, the cable extracts and retracts. A spring within the transducer maintains tension in the cable. The movement of the cable rotates a precision potentiometer, encoder, servo, or synchro within the transducer that produces an electrical output indicative of the cable travel. This, then, effectively translates into an indication of the extension of hydraulic actuator 54.

The extensible cable 68 has a second cable portion 69 which extends from sheath 66. Cable portion 69 is secured to the piston rod 60 by means of a clip 70 which, as best seen in FIG. 5, may take the form of a band 70. The cable 68 also has a first cable portion 71 (FIG. 8) which extends from the transducer casing 64. The first and second portions 71 and 69, are attached together within sheath 66. Band 70 encircles the piston rod 60, and straps the cable portion 69 to the piston 60 at the end of the piston 60 which is adjacent the bucket linkage 38. As used herein, "clip" is intended to mean any arrangement for securing the end of the cable 68 to the piston rod 60, including bands, clamps, and modifications to the piston rod 60, as well as connectors of various types, such as screws, bolts, and pins.

As best seen in FIG. 6, a transducer mounting 72 secures the casing 64 of the cable extension linear position transducer 62 to the hydraulic cylinder 56 in fixed relationship. The mounting 72 includes mounting plate 74 which is attached to the casing 64 by means of three threaded bolts 75 (only one of which is shown). Mounting plate 74 is secured to the cylinder 56 by means of U-bolt 76 and nuts 78 (only one of which is shown). U-bolt 76 extends over the cylinder 56 and through openings 80 in mounting plate 74, where the threaded ends of U-bolt 76 are engaged by nuts 78, clamping the mounting 72 to the cylinder 56. If desired, plate 74 may be curved or slightly V-shaped to conform to the exterior of cylinder 56. As used herein, "transducer mounting" is intended to mean any type of mechanical arrangement for securing the casing 64 of the cable extension linear position transducer 62 to the hydraulic cylinder 54 in fixed relationship, whether or not directly or indirectly, and includes brackets, bands, clamps, and connectors of various types including screws, bolts, and pins. By this arrangement, extension or contraction of the hydraulic actuator 54 causes the output of the transducer 62 to vary, thus providing an electrical output indicating the extension of the actuator 54 and the relative angular orientation of the excavator bucket 36 with respect to the dipper stick 26. As stated previously, although the output of the transducer 62 does not directly indicate the orientation of the bucket 36, the output of the transducer 62 does however directly correlate with the orientation of the bucket 36.

A mounting for securing the sheath 66 to the hydraulic cylinder 56 near the end of the cylinder 56 from which the piston rod 60 emerges includes a pair of bands 82 which strap the sheath 66 to the cylinder 56. As seen in FIGS. 4 and 6, other bands 84 may also be used to strap the sheath to the cylinder 56. As will be noted, FIGS. 2 and 3 illustrate the sheath 66 and the extensible cable 68 extending along the cylinder 56 and piston rod 60 on the sides thereof which directly face the dipper stick 26. This orientation provides maximum protection from damage which could be caused by the sheath 66 or the cable 68 contacting debris during operation of the excavator. While providing maximum shielding of the sheath 66 and cable 68, in some applications this orientation may increase the risk of damage to sheath 66 or cable 68 from material that may become trapped between the hydraulic actuator 54 and the dipper stick. A compromise in the orientation is shown in FIGS. 4–6, in which the sheath 66 and extensible cable 68 extend along the cylinder 56 and the piston rod 60 on the sides thereof generally, but not directly facing the dipper stick 26. By this arrangement, the sheath 66 and extensible cable 68 are partially protected by the cylinder 56 and piston rod 60, but the cable 68 and sheath 66 will not be damaged should material become lodged between the dipper stick 26 and the hydraulic actuator 54. It will be appreciated additionally that mounting transducer 62 such that it is positioned between ridges 59 also provides protection for the casing 64 of the transducer 62.

Figure 7:
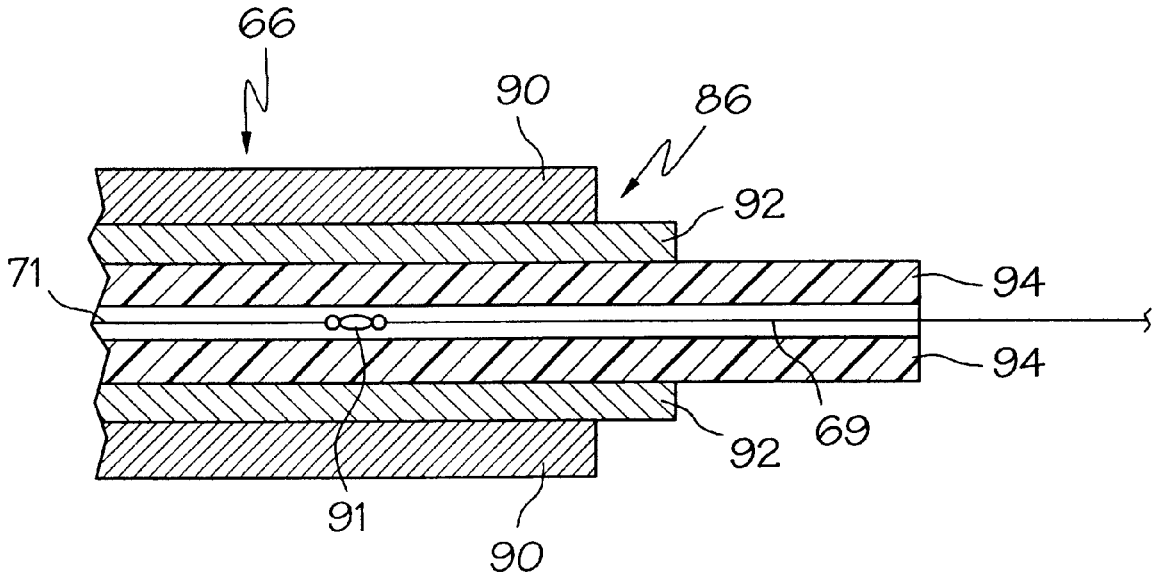
FIG. 7 is an enlarged partial sectional view of the rigid end portion of the transducer sheath.

Reference is now made to FIG. 7, in conjunction with FIGS. 4 and 5, which illustrates the construction of sheath 66 in greater detail. The sheath 66 includes a rigid end portion 86 from which cable portion 69 extends, and a flexible sheath portion 88. Rigid end portion 86 and flexible sheath portion 88 are joined together by fitting 89. The rigid end portion 86 provides a means of positioning the cable 68 such that the cable emerges from sheath 66 in close proximity to the piston 60 and extends to clip 70 in close proximity to piston 60. Maintaining cable 68 close to piston 60 tends to shield cable 68 and makes damage to cable 68 less likely. As seen in FIG. 7, the rigid end portion 86 includes an outer rigid tube 90, an inner rigid tube 92, within the outer rigid tube 90, and a flexible liner 94 within the inner rigid tube 92. Tubes 90 and 92 are preferably metal, such as for example stainless steel. Liner 94 is preferably a polypropylene woven jacket which facilitates the smooth movement of cable portion 69 through end portion 86. Utilizing two tubes 90 and 92 makes crimping and restriction of movement of cable portion 69 less likely, when the rigid end portion is bent into the shape illustrated in the drawings.

Figure 8:
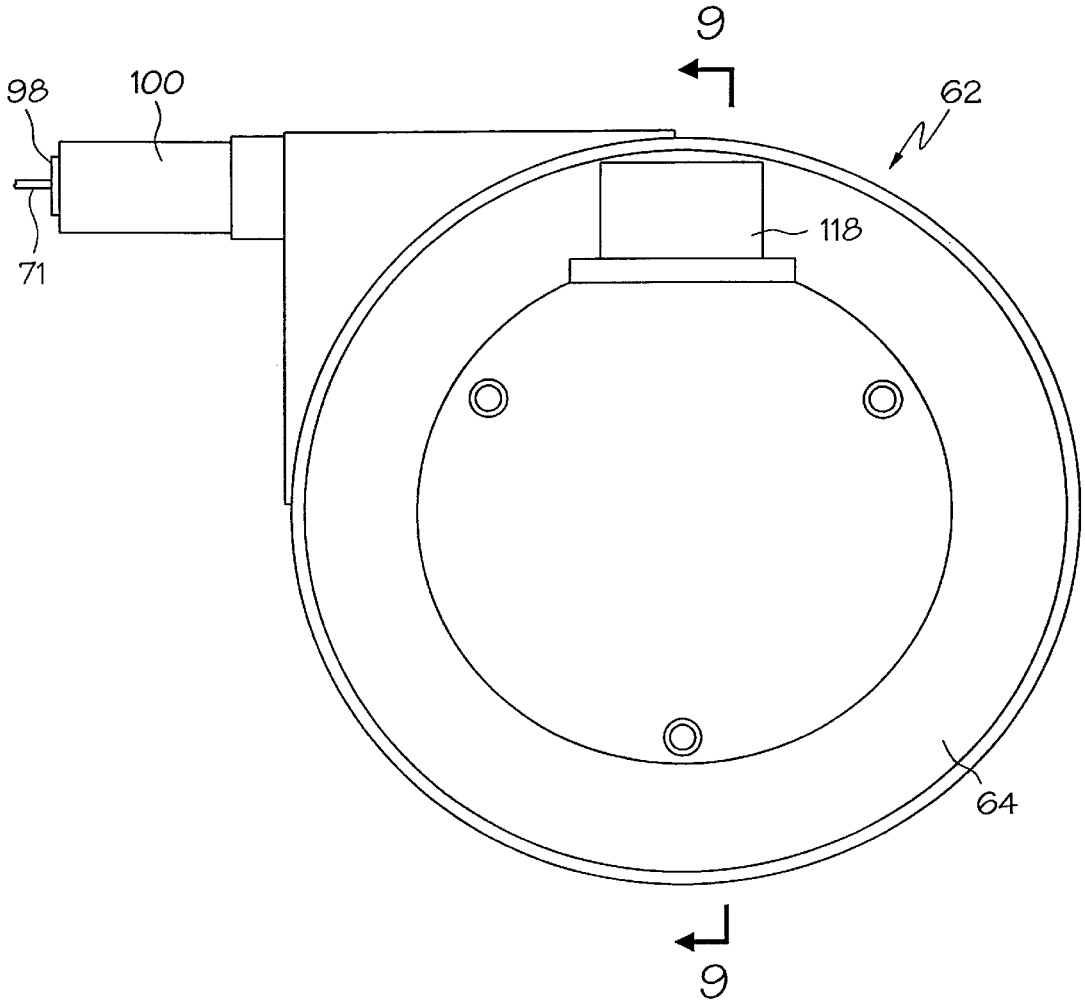
FIG. 8 is a side view of the transducer.
Figure 9:
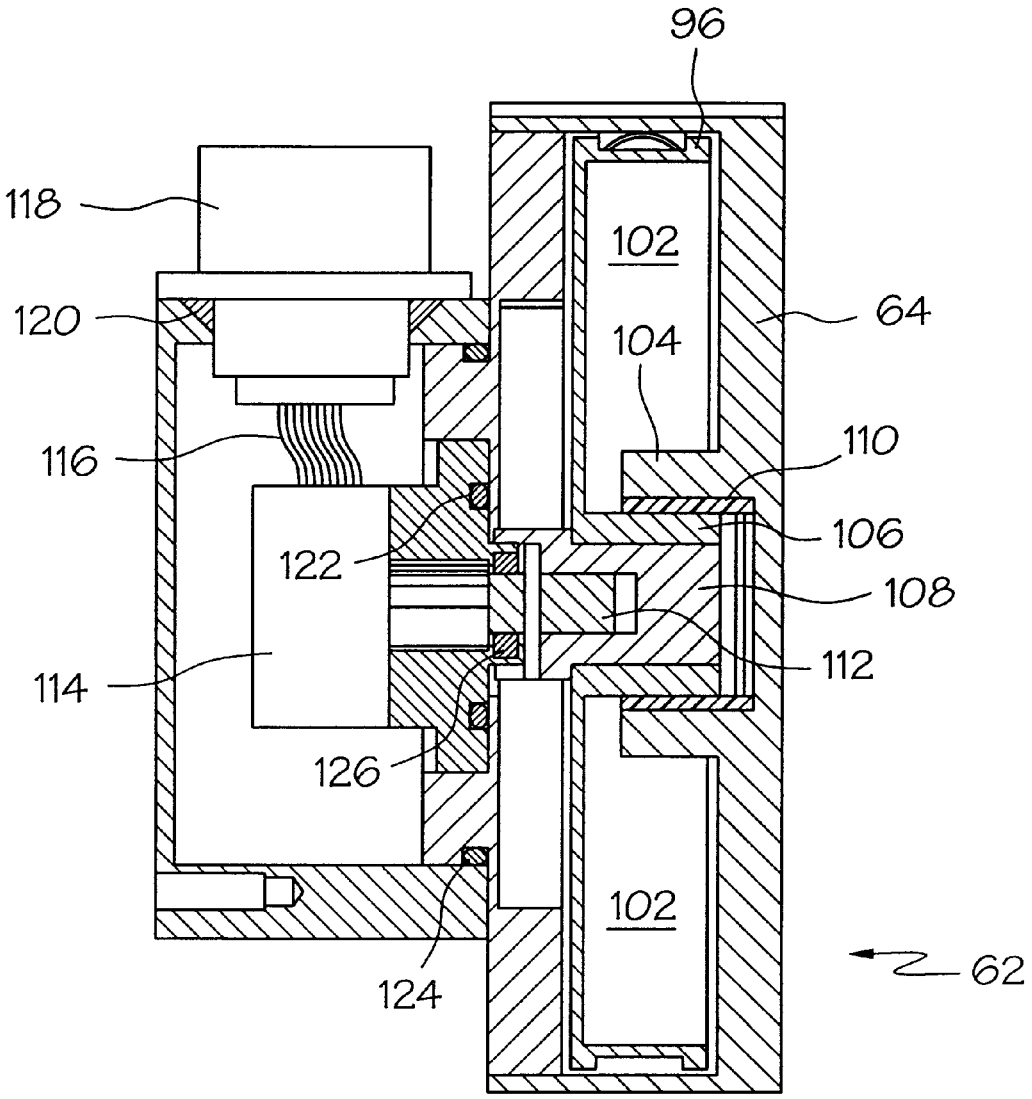
FIG. 9 is a sectional view of the transducer, taken generally along line 9—9 of FIG. 8.

Reference is now made to FIGS. 8 and 9 which illustrate the construction of the cable extension linear position transducer 62. As stated previously, the extensible cable 68 has a second cable portion 69 that is secured to the piston rod 60 and a first cable portion 71 which extends from the transducer casing. Cable portion 71 extends from the transducer casing 64 and is attached to second cable portion 69 within the sheath 66. These cable portions are attached together by means of clips 91 FIG. 7 which travel within the flexible sheath portion 88. Should the second cable portion 69 (the portion of the cable 68 which is exposed outside of sheath 66) be torn or cut, the cable 71 will be rapidly rewound onto cable reel 96. A spring loaded bumper 98, surrounding the opening from which first cable portion 71 extends, will cushion the impact of the clips 91 that join the cable portions together striking the fitting 100 which extends from casing 64. This prevents the clips 91 from being broken from the end of cable portion 71, and facilitates replacement of cable portion 69.

For purposes of clarity, the cable portion 71 has been removed from the sectional view of FIG. 9, as has the helical spring which spirals within annular space 102 defined by cable reel 96. The helical spring is attached to reel 96 and to the portion 104 of casing 64, such that as the cable portion is withdrawn from the transducer and unwound from the reel 96, the helical spring becomes increasingly coiled and the cable 68 is maintained under tension as piston rod 60 moves in either direction.

The reel 96 has a hub portion 106 which is pressed on connector 108. Reel 96 rotates within self-lubricating bushing 110. Connector 108 is, in turn, pinned to shaft 112 of optical quadrature encoder 114. Encoder 114 provides an electrical output via conductors 116 to electrical connector 118. The electrical output from connection 118 may be accumulated, providing an indication of the then current extension or contraction of the hydraulic actuator 54. This, in turn, is directly related to the relative angular orientation between the excavator bucket 36 and the dipper stick 26.

As will be appreciated, the arrangement of the present invention is operated under adverse environmental conditions. Accordingly, it is desirable to seal the casing 64, and especially the portion of the casing 64 in which encoder 114 is mounted. For this purpose, seals 120, 122, 124, and 126 are provided.

The flexible sheath portion 88 is attached to the transducer casing 64 at fitting 100. It will be further appreciated that sheath portion 88 may be subjected to ambient temperature fluctuations when the arrangement of the present invention is operated at a job site. This temperature change may undesirably lengthen or shorten sheath portion 88 which could result in an error in the electrical output from transducer 62. In order to prevent this, it may be desired to couple sheath portion 88 to fitting 100 by an arrangement that permits the sheath portion to slip over the fitting, compensating for changes in the length of the sheath portion 88 which result from temperature changes.

Having described the present invention in detail and by reference to various embodiments thereof, it will be apparent that certain modifications and variations are possible without departing from the scope of the invention defined in the appended claims.

What is claimed is:

1. An arrangement for determining the relative angular orientation of an excavator bucket with respect to a dipper stick of an excavator, comprising:

an excavator with a dipper stick;

an excavator bucket being mounted on a bucket linkage pivotally secured to an end of the dipper stick, the excavator including an hydraulic actuator having an hydraulic cylinder pivotally connected to said dipper stick and a piston rod pivotally connected to said bucket linkage, whereby extension or contraction of said hydraulic actuator causes said excavator bucket to be pivoted by said bucket linkage with respects to said dipper stick, a cable extension linear position transducer having a transducer casing, a sheath extending from said casing, and an extensible cable including a first cable portion extending from said transducer casing, an a second cable portion extending from said sheath, said first and second cable portion being attached together within said sheath by clips, said transducer providing an electrical output related to the extension of said cable from said sheath, a transducer mounting for securing said casing of said extension linear position transducer in fixed relationship to said hydraulic cylinder, and a clip for securing said extensible cable to said piston rod of said hydraulic actuator, whereby extension or contraction of said hydraulic actuator causes the electrical output of said transducer to vary, thus providing an electrical output indicating the relative angular orientation of said excavator bucket with respect to said dipper stick.

2. The arrangement for determining the relative angular orientation of an excavator bucket with respect to the dipper stick of an excavator according to claim 1, in which said clip includes a band around said piston rod, strapping said cable to said piston rod adjacent said bucket linkage.

3. The arrangement for determining the relative angular orientation of an excavator bucket with respect to the dipper stick of an excavator according to claim 1, further comprising a mounting for securing said sheath to said hydraulic cylinder near the end of said cylinder from which said piston rod emerges.

4. The arrangement for determining the relative angular orientation of an excavator bucket with respect to the dipper stick of an excavator according to claim 3, in which said sheath includes a rigid end portion from which said cable extends, said rigid end portion being oriented such that said cable emerges therefrom in close proximity to said piston rod and extends to said clip in close proximity to said piston rod.

5. The arrangement for determining the relative angular orientation of an excavator bucket with respect to the dipper stick of an excavator according to claim 4, in which said rigid end portion includes an outer rigid tube, an inner rigid tube within said outer rigid tube, an a flexible liner within said inner rigid tube.

6. The arrangement for determining the relative angular orientation of an excavator bucket with respect to the dipper stick of an excavator according to claim 1, in which said cable extension linear position transducer is mounted such that said sheath and extensible cable extend along said cylinder and said piston rod on the sides thereof generally facing said dipper stick, whereby said sheath and extensible cable are partially protected by said cylinder and said piston rod.

7. The arrangement for determining the relative angular orientation of an excavator bucket with respect to the dipper stick of an excavator according to claim 6, in which said cable extension linear position transducer is mounted such that said sheath and extensible cable extend along said cylinder and said piston rod on the sides thereof generally, but not directly facing said dipper stick, whereby said sheath and extensible cable are partially protected by said cylinder and said piston rod, but said cable and sheath will not be damaged should material become lodged between said dipper stick and said hydraulic cylinder and said piston rod.

8. The arrangement for determining the relative angular orientation of an excavator bucket with respect to the dipper stick of an excavator according to claim 6, in which said cable extension linear position transducer is mounted such that said sheath and said extensible cable extend along said cylinder and said piston rod on the side thereof directly facing said dipper stick.

9. An arrangement for determining the relative angular orientation between a first machine element and a second machine element, comprising:

first and second machine elements being pivotally connected, and an hydraulic actuator having an hydraulic cylinder pivotally connected to said first machine element and a piston rod pivotally connected to said second machine element, whereby extension or contraction of said hydraulic actuator causes relative pivotal movement between said first and second machine elements, a cable extension linear position transducer having a transducer casing, a sheath extending from said casing, and an extensible cable including a first cable portion extending from said transducer casing, an a second cable portion extending from said sheath, said first and second cable portion being attached together within said sheath by clips, said transducer providing an electrical output related to the extension of said cable from said sheath, a transducer mounting for securing said casing of said extension linear position transducer in fixed relationship to said hydraulic cylinder, and a clip for securing said extensible cable to said piston rod, whereby extension or contraction of said hydraulic actuator causes the electrical output of said transducer to vary, thus providing an electrical output indicating the relative angular orientation between said first machine element and said second machine element.

10. The arrangement for determining the relative angular orientation between a first machine element and a second machine element according to claim 9, in which said clip includes a band around said piston rod, strapping said cable to said piston rod adjacent said second machine element.

11. The arrangement for determining the relative angular orientation between a first machine element and a second machine element according to claim 9, further comprising a mounting for securing said sheath to said hydraulic cylinder near the end of said cylinder from which said piston rod emerges.

12. The arrangement for determining the relative angular orientation between a first machine element and a second machine element according to claim 11, in which said sheath includes a rigid end portion from which said cable extends, said rigid end portion being oriented such that said cable emerges therefrom in close proximity to said piston rod and extends to said clip in close proximity to said piston rod.

13. The arrangement for determining the relative angular orientation between a first machine element and a second machine element according to claim 12, in which said rigid end portion includes an outer rigid tube, an inner rigid tube within said outer rigid tube, an a flexible liner within said inner rigid tube.

14. The arrangement for determining the relative angular orientation between a first machine element and a second machine element according to claim 9, in which said cable extension linear position transducer is mounted such that said sheath and extensible cable extend along said cylinder and said piston rod on the sides thereof generally facing said first machine element, whereby said sheath and extensible cable are partially protected by said cylinder and said piston rod.

15. The arrangement for determining the relative angular orientation between a first machine element and a second machine element according to claim 14, in which said cable extension linear position transducer is mounted such that said sheath and extensible cable extend along said cylinder and said piston rod on the sides thereof generally, but not directly facing said first machine element, whereby said sheath and extensible cable are partially protected by said cylinder and said piston rod, but said cable and sheath will not be damaged should material become lodged between said first machine element and said hydraulic cylinder and said piston rod.

16. The arrangement for determining the relative angular orientation between a first machine element and a second machine element according to claim 14, in which said cable extension linear position transducer is mounted such that said sheath and said extensible cable extend along said cylinder and said piston rod on the side thereof directly facing said dipper stick.

17. An arrangement for determining the relative angular orientation between a first machine element and a second machine element, comprising:

first and second machine elements being pivotally connected, and a linear actuator having a first actuator element pivotally connected to said first machine element and a second actuator element pivotally connected to said second machine element, said first and second machine elements being linearly moveable with respect to each other whereby relative linear movement of said actuator elements causes relative pivotal movement between said first and second machine elements, a cable extension linear position transducer having a transducer casing, a sheath extending from said casing, and an extensible cable including a first cable portion extending from said transducer casing, an a second cable portion extending from said sheath, said first and second cable portion being attached together within said sheath by clips, said transducer providing an electrical output related to the extension of said cable from said sheath, a transducer mounting for securing said casing of said extension linear position transducer in fixed relationship to said first actuator element, and a clip for securing said extensible cable to said second actuator element, whereby extension or contraction of said first and second elements causes the electrical output of said transducer to vary, thus providing an electrical output indicating the relative angular orientation between said first machine element and said second machine element.

18. The arrangement for determining the relative angular orientation between a first machine element and a second machine element according to claim 17, in which said clip includes a band around said second actuator element, strapping said cable to said second actuator element adjacent said, second machine element.

19. The arrangement for determining the relative angular orientation between a first machine element and a second machine element according to claim 17, further comprising a mounting for securing said sheath to said first actuator element.

20. The arrangement for determining the relative angular orientation between a first machine elements and a second machine element according to claim 19, in which said sheath includes a rigid end portion from which said cable extends, said rigid end portion being oriented such that said cable emerges therefrom in close proximity to said second actuator element and extends to said clip in close proximity to said second actuator element.

21. The arrangement for determining the relative angular orientation between a first machine element and a second machine element according to claim 20, in which said rigid end portion includes an outer rigid tube, an inner rigid tube within said outer rigid tube, an a flexible liner within said inner rigid tube.

22. The arrangement for determining the relative angular orientation between a first machine elements and a second machine element according to claim 17, in which said cable extension linear position transducer is mounted such that said sheath and extensible cable extend along said first actuator element and said second actuator element on the sides thereof generally facing said first machine element.

23. The arrangement for determining the relative angular orientation between a first machine element and a second machine element according to claim 22, in which said cable extension linear position transducer is mounted such that said sheath and extensible cable extend along said first actuator element and said second actuator element on the sides thereof generally, but not directly facing said first machine element, whereby said sheath and extensible cable are partially protected by said first and second actuator elements, but said cable and sheath will not be damaged should material become lodged between said first machine element and said first and second actuator elements.

* * * * *

UNITED STATES PATENT AND TRADEMARK OFFICE

CERTIFICATE OF CORRECTION

PATENT NO : 6,099,235

DATED : August 8, 2000

INVENTOR(S) : Garry L. Cain and Richard Piekutowski

It is certified that error appears in the above-identified patent and that said Letters Patent are hereby corrected as shown below:

Claim 18, Col. 10, Line 14 "said, second" should read --said second--.

Signed and Sealed this

Tenth Day of April, 2001

*Attest:*

Nicholas P. Godici

NICHOLAS P. GODICI

*Attesting Officer*

*Acting Director of the United States Patent and Trademark Office*